US006274011B1

(12) United States Patent
Andreas et al.

(10) Patent No.: US 6,274,011 B1
(45) Date of Patent: Aug. 14, 2001

(54) TRACK ASSEMBLY AND CONTAINER FOR ELECTROLYTIC PROCESS

(75) Inventors: Phillip L. Andreas; Eric Voss, both of Green Bay, WI (US)

(73) Assignee: Corrosion Technology International, Inc., Dallas, TX (US)

( * ) Notice: Subject to any disclaimer, the term of this patent is extended or adjusted under 35 U.S.C. 154(b) by 0 days.

(21) Appl. No.: 09/415,151

(22) Filed: Oct. 8, 1999

(51) Int. Cl.[7] ..... C25B 9/00; B65D 85/84; B65D 6/08; B29D 22/00

(52) U.S. Cl. ..... 204/279; 206/524.5; 220/676; 220/DIG. 6; 428/35.7

(58) Field of Search ..... 204/279; 206/524.5; 220/676, DIG. 6; 428/35.7

(56) References Cited

U.S. PATENT DOCUMENTS 3,763,083 * 10/1973 Grotheer ..... 204/279 X
3,962,066 * 6/1976 Barber et al. ..... 204/279
5,037,520 * 8/1991 Harry et al. ..... 204/279
5,066,379 11/1991 Harry et al. .
5,079,050 1/1992 Harry et al. .
6,048,593 * 4/2000 Espeland et al. ..... 428/34.1

FOREIGN PATENT DOCUMENTS

PCT/F198/
00655 8/1998 (FI) .

* cited by examiner

*Primary Examiner*—Donald R. Valentine
(74) *Attorney, Agent, or Firm*—Craig G. Cochenour

(57) ABSTRACT

A track assembly and electrolytic container for the electrorefining and electrowinning of metals is disclosed. The container of this invention has mirror image integrally cast lip and trough sections in each interior side wall of the container for accepting a track assembly. The track assembly has a track means for engaging and guiding a separating member and a track retainer means for frictionally engaging and securing the track means to both of the interior side walls. The track assembly and electrolytic container of the instant invention facilitates the removal of unwanted slimes from the electrolytic container while keeping the electrolytic process operational during the removal period.

12 Claims, 4 Drawing Sheets

TRACK ASSEMBLY AND CONTAINER FOR ELECTROLYTIC PROCESS

BACKGROUND OF THE INVENTION

1. Field of the Invention

This invention relates to containers for highly corrosive solutions and more particularly to containers for use in the electrolytic refinement or electrowinning of metals such as for example, copper, cobalt, nickel and zinc.

The electrolytic refining process for various metals results in the deposition of by-products on the floor of the electrolytic container. The by-products are known by those skilled in the art as "slimes". The slimes include precious metals, such as for example, gold and silver, and impurities contained in the electrolyte. These by-products over time accumulate as a slurry on the floor of the electrolytic container. Up until the present invention, removal of the slimes from the container involved removing the cathodes and anodes (i.e., the electrodes) contained within the electrolytic container, decanting the liquid electrolyte in the container above the slimes and then draining the slimes from the bottom floor of the container. Prior to the present invention, removal of the slimes, involved stopping the entire electrolytic process to accomplish the removal of the accumulated precious metals and salt impurities that accumulated on the bottom of the electrolytic container. As will be understood by those skilled in the art, the slimes were required to be removed in the course of the electrolytic process to prevent the deposition of the slimes on the cathode. Deposition of the slimes on the cathode results in a drop in the purity of the metal to be produced by the electrolytic process. Interruption of the electrolytic process to accomplish slime removal reduces the efficiency and the productivity of the electrolytic plant. Removal of the electrodes and electrolyte from the electrolytic container and the manual washing of the electrolytic container makes the process of removing slimes labor-intensive and subjects individuals carrying out these tasks to various health hazards due to the potential for contact with the corrosive liquid electrolyte.

The present invention provides a track assembly and electrolytic container for the automated removal of the slimes from the bottom of the container while the electrolytic process carried out in the container remains operational. Thus, manual labor of removing the electrodes and electrolyte and washing of the container is minimized and/or substantially eliminated along with the above-mentioned health risks.

2. Brief Description of the Background Art

U.S. Pat. No. 5,066,379 ('379 Patent) discloses a container for corrosive material. The '379 Patent discloses an electrolytic container formed of polymer concrete having an integrally molded overflow box, inlet channel, decanting passage, discharge pipe and drain hole. This patent discloses that sludge on or near the bottom of the container is drained from the container through a normally plugged drain hole. The '379 Patent sets forth that the bottom of the container is sloped from one side and one end or both sides and one end to facilitate the removal of sludge.

PCT/F198/00655 ('655 Application) entitled, "Separating Member for Separating the Tank Bottom Part from the Rest of the Tank" discloses a separating member for separating the bottom part of an electrolytic tank from the rest of the tank in connection with the removal of solids settled onto the bottom of the electrolytic tank. The '655 Application discloses support and control members installed in the electrolytic tank which form the trajectory of the separating member. In contrast, the present invention provides an integrally molded container allowing engagement of the track without mechanical fasteners that can corrode or create unacceptable stresses in the polymer composite of the electrolytic container construction.

While the above-mentioned background art electrolytic containers and separating members are known, they do not disclose an electrolytic container having the unique integrally molded lip and trough section embodiments of the present invention, nor is the background art concerned with providing a track assembly and an electrolytic container having a constant and uniform cross-section of the track slot from the entry point at the top of the electrolytic container through the vertical path, the curved elbow transition section, and horizontal path of the lip and trough section of the shell as described herein by the present invention.

Therefore, in spite of this background material, there remains a very real and substantial need for an electrolytic container having an integrally molded shell and track assembly capable of mechanically engaging and guiding a bendable separating member providing for the separation of the slimes on the bottom of the electrolytic container from the electrolyte that is in the rest of the electrolytic container. Having the separating member in place and engaged in the track assembly of this invention provides for the elimination of the slimes from the electrolytic container during active operation of the electrorefining process.

SUMMARY OF THE INVENTION

The present invention has met the above-described needs. The present invention provides a electrolytic container comprising a cured polymer concrete shell having an integrally cast lip and trough section on the interior side walls. The trough section and lip of the present invention form an area in the interior of the side wall having a cavity. The present invention provides an electrolytic container including at least two track assemblies, each having track means for mechanically engaging and guiding a bendable separating member. The track means of the present invention is in juxtaposition to and in communication with the cavity of the interior side wall formed by the trough section and the lip of the shell. The instant invention further provides retainer means for frictionally engaging the track means and the lip of the interior side wall of the shell of the container. The retainer means secures the track means to the cavity of the interior side wall of the shell. One track assembly is secured to each interior side wall of the container.

Another embodiment of the present invention provides the electrolytic container as described herein, wherein any one point of reference along the track assembly as secured in the cavity area of one of the interior side walls is equidistant relative to a mirror image corresponding point of reference of the other track assembly secured in the cavity area of the other interior side wall.

A further embodiment of the instant invention provides an electrolytic container having a track means that includes a bottom face having a groove. The groove of the bottom face of the track means of the present invention accommodates an elastic gasket. The elastic gasket is flexible and compressible, thus allowing the retainer means to be positioned on top of the track means by frictional engagement as described herein.

The track assembly and the electrolytic container of the present invention will be more fully understood from the following descriptions of the invention, the drawings and the claims appended hereto.

DETAILED DESCRIPTION OF THE INVENTION

Figure 1:
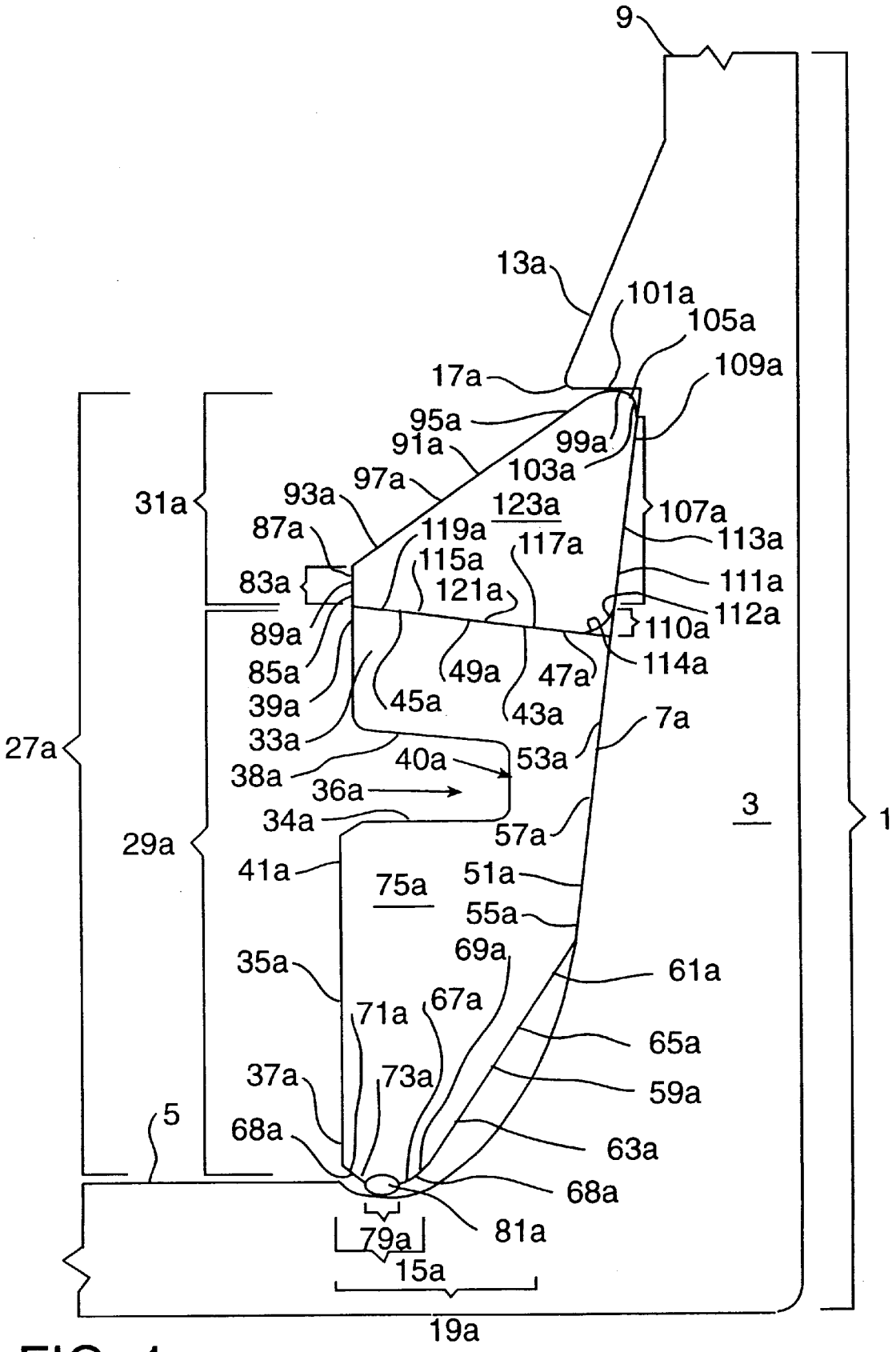
FIG. 1 is a partial sectional side view of a form of the track assembly, track means, retainer means and the integrally cast lip and trough section of the electrolytic container of the present invention, wherein the retainer means is shown frictionally engaging the track means to secure the track means in the cavity of the interior side wall.
Figure 2:
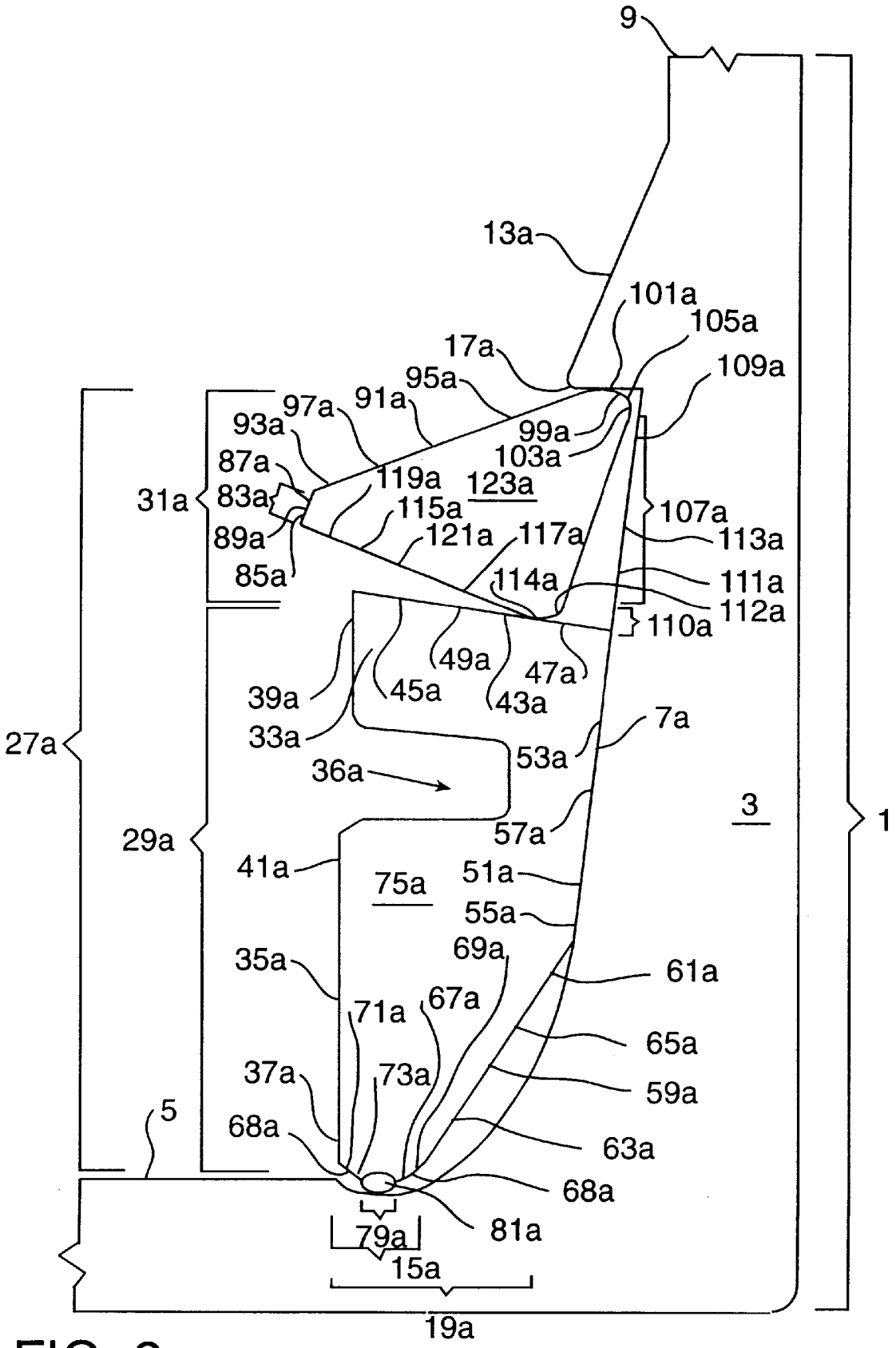
FIG. 2 is a partial sectional side view of a form of the track assembly, track means, retainer means and the integrally cast lip and trough section of the electrolytic container of the present invention, wherein the retainer means is shown as it rotates into position while causing mechanical compression of the elastic gasket of the track.
Figure 3:
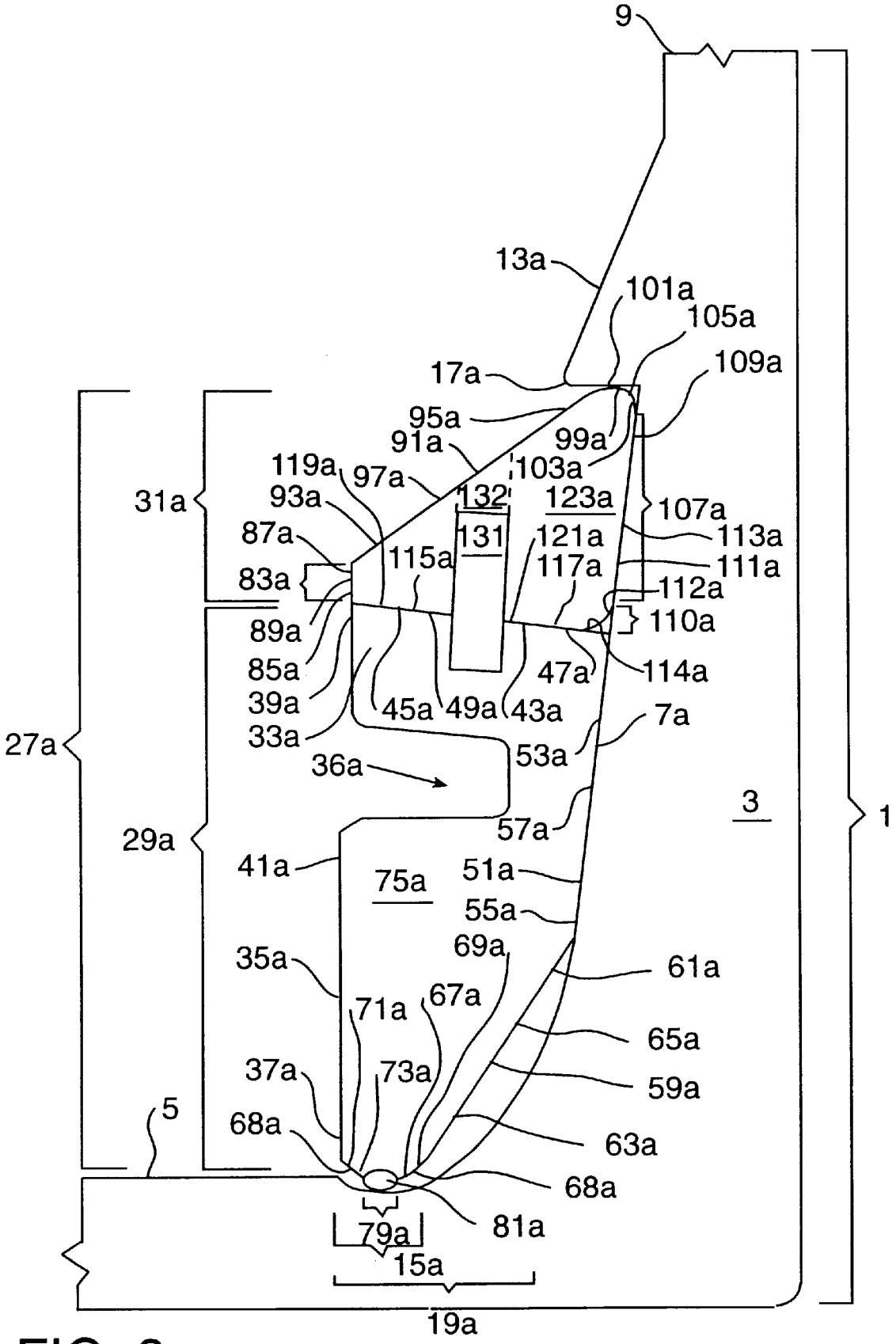
FIG. 3 is a partial sectional side view of a form of the track assembly and the electrolytic container of the instant invention that shows an optional embodiment of the present invention wherein a pin is inserted through the inclined face of and through the body of the retainer means and through the top face and body of the track.
Figure 4:
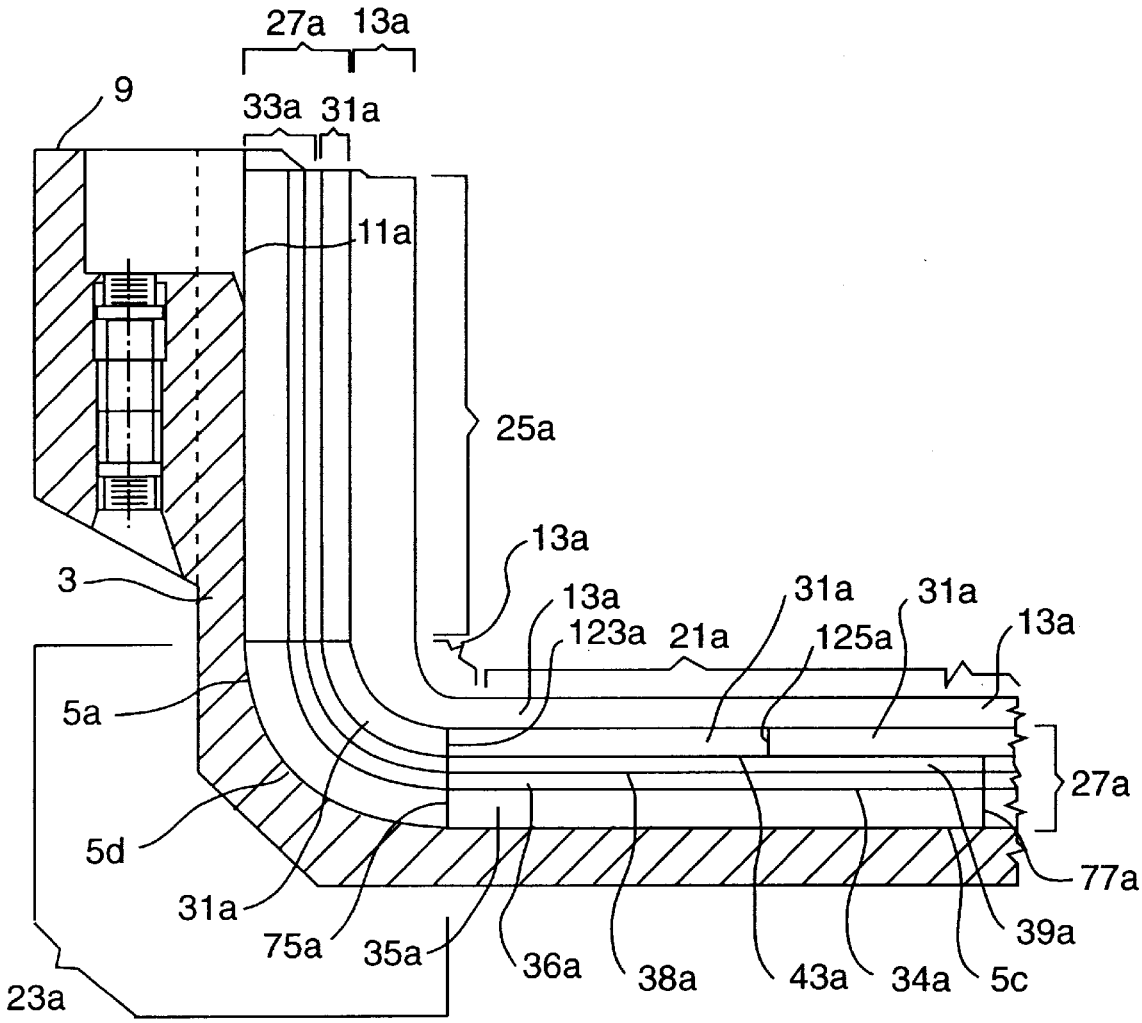
FIG. 4 is a partial left side view of a form of the track assembly and electrolytic container of the present invention that shows the modular sections of the track and retainer means installed in the electrolytic container.

The present invention provides for a track assembly and electrolytic container for use in the electrorefining or electrowinning of various metals such as for example, but not limited to, copper, zinc, nickel and cobalt. FIGS. 1–4 illustrate various views of a preferred form of the track assembly and electrolytic container of the present invention. In FIGS. 1–4, the electrolytic container comprises a cured polymer concrete shell 3, having a floor 5, a pair of tapered interior side walls 7*a*, 7*b* (7*b* not shown in FIGS. 1–4) wherein the taper provides a greater width at the top 9 of the shell relative to the floor 5 of the shell. FIG. 4 shows that the shell 3 has a pair of opposed interior end walls 11*a*, 11*b* (11*b* not shown in FIG. 4; 11*a* and 11*b* not shown in FIGS. 1–3). In FIGS. 1–3, each of the interior side walls 7*a*, 7*b* include a lip 13*a*, 13*b* (13*b* not shown in FIGS. 1–3) and trough section 15*a*, 15*b* (15*b* not shown in FIGS. 1–3). The lip 13*a*, 13*b* has a negative return surface 17*a*, 17*b* (17*b* not shown in FIGS. 1–4; 17*a* not shown in FIG. 4) that is integrally cast on the interior side wall 7*a*, 7*b* of the shell 3. The lip 13*a*, 13*b* is located above the trough section 15*a*, 15*b*, wherein the trough section 15*a*, 15*b* is integrally cast on the bottom portion of the interior side wall 7*a*, 7*b* of the shell 3. In FIGS. 1–3, the trough section 15*a*, 15*b* is in juxtaposition to and in communication with the floor 5, and wherein the lip 13*a*, 13*b* and the trough section 15*a*, 15*b* form an area in the interior side wall 7*a*, 7*b* having a cavity 19*a*, 19*b* (19*b* not shown in FIGS. 1–3). The lip 13*a*, 13*b* and the trough section 15*a*, 15*b* extend in a substantially horizontal path 21*a*, 21*b* (21*b* not shown in FIG. 4)along the length of each of the interior side walls 7*a*, 7*b*. FIG. 4 shows that the floor 5 has a first end 5*a* (FIG. 4), a second end 5*b* (not shown in FIG. 4) and a middle section 5*c* (FIG. 4) disposed between the first end 5*a* and the second end 5*b*, wherein the first end 5*a* of the floor 5 has an arcuate shape 5*d* (FIG. 4). Preferably, arcuate shape 5*d* has a radius of curvature from about 180 to 380 millimeters. The arcuate shape 5*d* bows upwardly relative to the middle section 5*c* of the floor 5 such that the first end 5*a* of the floor 5 communicates with interior end wall 11*a* of the shell 3. The lip 13*a*, 13*b* and the trough section 15*a*, 15*b* continue from the horizontal path 21*a*, 21*b* (21*b* not shown in FIG. 4) along the length of the interior side wall 7*a*, 7*b* (7*b* not shown in FIG. 4) to form a curved elbow transition section 23*a*, 23*b* (23*b* not shown in FIG. 4) on the interior side wall 7*a*, 7*b* (7*b* not shown in FIG. 4). The curved elbow transition section 23*a*, 23*b* each has a radius of curvature from about 180 to 390 millimeters that is substantially similar to the radius of curvature of the arcuate shape 5*d* of the first end 5*a* of the floor 5. It will be understood by those skilled in the art that FIG. 4 shows that the present invention includes wherein the lip 13*a*, 13*b* (13*b* not shown in FIG. 4) and the trough section 15*a*, 15*b* (15*a* and 15*b* not shown in FIG. 4) continue to extend in a vertical path 25*a* (FIG. 4) on the interior side wall 7*a*, 7*b* (7*b* not shown in FIG. 4) from the curved elbow transition section 23*a*, 23*b*, respectively, to the top 9 of the shell 3.

Any one point of reference along the lip 13*a* and the trough section 15*a* of interior side wall 7*a* is equidistance relative to a mirror-image corresponding point of reference of the lip 13*b* and the trough section 15*b* of the interior side wall 7*b* throughout the horizontal paths 21*a* and 21*b*, respectively, the curved elbow transition sections 23*a* and 23*b*, respectively, and the vertical paths 25*a* and 25*b*, respectively.

The container of the present invention, as described herein, further includes at least two track assemblies 27*a*, 27*b* (27*b* not shown in FIGS. 1–4) each having (i) track means 29*a*, 29*b* (29*b* not shown; and all further reference numerals bearing a letter "b" for all future elements of this invention are not shown in FIGS. 1–4) for mechanically engaging and guiding a bendable separating member (not shown) wherein the track means 29*a*, 29*b* is in juxtaposition to and in communication with at least a portion of the cavity 19*a*, 19*b* of the interior side wall 7*a*, 7*b* formed in part by the trough section 15*a*, 15*b* and the lip 13*a*, 13*b*, and (ii) retainer means 31 a, 31*b* for frictionally engaging the track means 29*a*, 29*b* and the negative return surface 17*a*, 17*b* of the lip 13*a*, 13*b* of the interior side wall 7*a*, 7*b* for securing the track means 29*a*, 29*b* to the interior side wall 7*a*, 7*b*, respectively, of the shell 3, as shown in FIGS. 1–3.

The retainer means 31*a*, 31*b* is in communication with and is positioned above the track means 29*a*, 29*b*, respectively, and below the negative return surface 17*a*, 17*b* of the lip 13*a*, 13*b*, respectively. One track assembly 27*a* is in juxtaposition to and in communication with one interior side wall 7*a* and wherein the other track assembly 27*b* is in juxtaposition to and in communication with the other interior side wall 7*b*.

In another embodiment of this invention, the track assembly and electrolytic container further includes wherein any one point of reference along the track assembly 27*a* is equidistance relative to a mirror image corresponding point of reference of the other track assembly 27*b*.

The track assembly and the electrolytic container of the present invention are fabricated with abrasion-resistant ceramics in the composite material to provide wear resistance to the sliding movement of the separating member that is engaged in the track means. The structural shape, as shown in FIGS. 1–4, of the electrolytic container of the present invention is designed to eliminate sharp corners and stress concentrations. More particularly, FIG. 4 shows the arcuate shape 5*d* of the floor 5 that communicates with the interior end wall 11*a* of the shell 3. U.S. Pat. No. 5,079,050, incorporated by reference herein, sets forth a polymer composite that may be used in the fabrication of the track assembly and electrolytic container of the present invention.

In another embodiment of the present invention as set forth in FIG. 1–3, the track assembly and container as described herein, further includes wherein the track means 29*a*, 29*b* comprises a track 33*a*, 33*b*, respectively. The track 33*a*, 33*b* has a front face 35*a*, 35*b* having a first end 37*a*, 37*b*, a second end 39*a*, 39*b*, and a middle section 41*a*, 41*b* disposed between the first end 37*a*, 37*b* and the second end 39*a*, 39*b*, respectively. The front face 35*a*, 35*b* of the track 33*a*, 33*b* is oriented such that it is exposed to the open interior space of the container 1. Further, the track 33*a*, 33*b* has a top face 43*a*, 43*b* having a first end 45*a*, 45*b*, a second end 47*a*, 47*b* and a middle section 49*a*, 49*b* disposed between the first end 45*a*, 45*b* and the second end 47*a*, 47*b*, respectively. FIGS. 1–3 show that the surface of the top face 43*a* of the track 33*a* is a sloped surface, wherein the slope proceeds downward from the first end 45*a* to the second end 47*a* of the top face 43*a*. Preferably, the slope of the top face 43*a* is at an angle of from about 1 to 15 degrees, and most preferably is an angle of about 10 degrees. The second end 39*a*, 39*b* of the front face 35*a*, 35*b* of the track 33*a*, 33*b* is in communication with the first end 45*a*, 45*b* of the top face 43*a*, 43*b* of the track 33*a*, 33*b*, respectively. Further, the track 33*a*, 33*b* includes a back face 51*a*, 51*b* having a first end 53*a*, 53*b*, a second end 55*a*, 55*b*, and a middle section 57*a*, 57*b* disposed between the first end 53*a*, 53*b* and the second end 55*a*, 55*b*, respectively. The first end 53*a*, 53*b* of the back face 51*a*, 51*b* of the track 33*a*, 33*b* is in communication with the second end 47*a*, 47*b* of the top face 43*a*, 43*b* of the track 33*a*, 33*b*, respectively. The back face 51*a*, 51*b* of the track 33*a*, 33*b* is in juxtaposition to and in communication with a portion of the interior side wall 7*a*, 7*b* above the trough section 15*a*, 15*b* and below the lip 13*a*, 13*b*, respectively. Further, the track 33*a*, 33*b* has a chamfered section 59*a*, 59*b* having a first end 61*a*, 61*b*, a second end 63*a*, 63*b* and a middle section 65*a*, 65*b* disposed between the first end 61*a*, 61*b* and the second end 63*a*, 63*b*, respectively. The first end 61*a*, 61*b* of the chamfered section 59*a*, 59*b* of the track 33*a*, 33*b* is in communication with the second end 55*a*, 55*b* of the back face 51*a*, 51*b* of the track 33*a*, 33*b*, respectively. When completely installed into position, FIGS. 1–3 show that the chamfered section 59*a*, 59*b* of the track 33*a*, 33*b* is free of any communication with the interior side wall 7*a*, 7*b*, respectively. Further, the track 33*a*, 33*b* has a bottom face 67*a*, 67*b* having a first end 69*a*, 69*b*, a second end 71*a*, 71*b* and a middle section 73*a*, 73*b* disposed between the first end 69*a*, 69*b* and the second end 71*a*, 71*b*, respectively. The first end 69*a*, 69*b* of the bottom face 67*a*, 67*b* of the track 33*a*, 33*b* is in communication with the second end 63*a*, 63*b* of the chamfered section 59*a*, 59*b* of the track 33*a*, 33*b*, respectively. The second end 71*a*, 71*b* of the bottom face 67*a*, 67*b* of the track 33*a*, 33*b* is in communication with the first end 37*a*, 37*b* of the front face 35*a*, 35*b* of the track 33*a*, 33*b*, respectively. Further, the track 33*a*, 33*b* has a pair of side walls 75*a*, 75*b* and 77*a* (not shown in FIGS. 1–3), 77*b* wherein each side wall 75*a*, 75*b* and 77*a*, 77*b* is in communication with the front face 35*a*, 35*b*, the top face 43*a*, 43*b*, the back face 51*a*, 51*b*, the chamfered section 59*a*, 59*b*, and the bottom face 67*a*, 67*b* of the track 33*a*, 33*b*, respectively. The bottom face 67*a*, 67*b* of the track 33*a*, 33*b* has an arcuate shape 68*a*, 68*b*, respectively. The arcuate shape 68*a*, 68*b* preferably has a radius of curvature of from about 20 to 25 millimeters. The bottom face 67*a*, 67*b* of the track 33*a*, 33*b* has a groove 79*a*, 79*b* extending from and through one side wall 75*a*, 75*b* of the track 33*a*, 33*b*, through the body of track 33*a*, 33*b* and through the other side wall 77*a*, 77*b* of the track 33*a*, 33*b*, respectively. The groove 79*a*, 79*b* accommodates a portion of a circumference of an elastic gasket 81*a*, 81*b*, respectively. FIGS. 1–3 show that the middle section 41*a*, 41*b* of the front face 35*a*, 35*b* of the track 33*a*, 33*b* has a slot 36*a*, 36*b*, respectively, for engaging and guiding the bendable separating member (not shown). FIGS. 1–3 show that slot 36*a*, 36*b* has a base surface 34*a*, 34*b*, a ceiling surface 38*a*, 38*b*, and a rear wall surface 40*a*, 40*b*, respectively. Slot 36*a*, 36*b* extends from and through one side wall 75*a*, 75*b* of the track 33*a*, 33*b*, through the body of the track 33*a*, 33*b*, and through the other side wall 77*a*, 77*b* (77*a* and 77*b* not shown in FIGS. 1–3) of the track 33*a*, 33*b*, respectively.

In FIGS. 1–3, the retainer means 31*a*, 31*b* has a front face 83*a*, 83*b* having a first end 85*a*, 85*b*, a second end 87*a*, 87*b*, and a middle section 89*a*, 89*b* disposed between the first end 85*a*, 85*b* and the second end 87*a*, 87*b*, respectively. The retainer means 31*a*, 31*b* further includes, an inclined face 91*a*, 91*b* having a first end 93*a*, 93*b*, a second end 95*a*, 95*b*, and middle section 97*a*, 97*b* disposed between the first end 93*a*, 93*b* and the second end 95*a*, 95*b*, respectively. FIGS. 1–3 show that the surface of the inclined face 91*a* of the retainer means 31*a* is a sloped surface, wherein the slope proceeds upward from the first end 93*a* to the second end 95*a* of the inclined face 91*a*. Preferably, the slope of the inclined face 91*a* is at an angle of from about 40 to 50 degrees, and most preferably is an angle of about 45 degrees.

The first end 93*a*, 93*b* of the inclined face 91*a*, 91*b* of the retainer means 31*a*, 31*b* is in communication with the second end 87*a*, 87*b* of the front face 83*a*, 83*b* of the retainer means 31*a*, 31*b*, respectively. The retainer means 31*a*, 31*b* further includes a chamfered face 99*a*, 99*b* having a first end 101*a*, 101*b*, a second end 103*a*, 103*b*, and a middle section 105*a*, 105*b* disposed between the first end 101*a*, 101*b* and the second end 103*a*, 103*b*, respectively. Preferably, the chamfered face 99*a*, 99*b* is a curved face, and most preferably the curved face has a radius of curvature from about 3 to 6 millimeters. The first end 101*a*, 101*b* of the chamfered face 99*a*, 99*b* of the retainer means 31*a*, 31*b* is in communication with the second end 95*a*, 95*b* of the inclined face 91*a*, 91*b* of the retainer means 31*a*, 31*b*, respectively. The retainer means 31*a*, 31*b* further includes a back face 107*a*, 107*b* having a first end 109*a*, 109*b*, a second end 111*a*, 111*b*, and a middle section 113*a*, 113*b* disposed between the first end 109*a*, 109*b* and the second end 111*a*, 111*b*, respectively. The first end 109*a*, 109*b* of the back face 107*a*, 107*b* of the retainer means 31*a*, 31*b* is in communication with the second end 103*a*, 103*b* of the chamfered face 99*a*, 99*b* of the retainer means 31*a*, 31*b*, respectively.

The retainer means 31*a*, 31*b* further includes a heel face 110*a*, 110*b* having a first end 112*a*, 112*b* and a second end 114*a* and 114*b*, respectively. The second end 111*a*, 111*b* of the back face 107*a*, 107*b* of the retainer means 31*a*, 31*b* is in communication with the first end 112*a*, 112*b* of the heel face 110*a*, 110*b* of the retainer means 31*a*, 31*b*, respectively. Preferably, the heel face 110*a*, 110*b* each have a radius of curvature of from about 3 millimeters to 6 millimeters.

The retainer means 31*a*, 31*b* further includes a bottom face 115*a*, 115*b* having a first end 117*a*, 117*b*, a second end 119*a*, 119*b*, and a middle section 121*a*, 121*b* disposed between the first end 117*a*, 117*b* and the second end 119*a*, 119*b*, respectively. The second end 114*a*, 114*b* of the heel face 110*a*, 110*b* of the retainer means 31*a*, 31*b* is in communication with the first end 117*a*, 117*b* of the bottom face 115*a*, 115*b* of the retainer means 31*a*, 31*b*, respectively. The second end 119*a*, 119*b* of the bottom face 115*a*, 115*b* of the retainer means 31*a*, 31*b* is in communication with the first end 85*a*, 85*b* of the front face 83*a*, 83*b* of the retainer means 31*a*, 31*b*, respectively. Further, the retainer means 31*a*, 31*b* of the present invention includes a pair of side walls 123*a*, 123*b* and 125*a*, 125*b*, respectively. Each side wall 123*a*, 123*b* and 125*a*, 125*b* is in communication with the front face 83*a*, 83*b*, the incline face 91*a*, 91*b*, the chamfered face 99*a*, 99*b*, the heel face 110*a*, 110*b*, the back face 107*a*, 107*b*, and the bottom face 115*a*, 115*b* of the retainer means 31*a*, 31*b*, respectively.

FIG. 1 shows the container 1 of the present invention wherein the bottom face 115*a* of the retainer means 31*a* is in frictional engagement with and is in communication with the top face 43*a* of the track 33*a*. FIG. 1 shows the chamfered face 99*a* of the retainer means 31*a* is in frictional engagement with and is in communication with the negative return surface 17*a*, of the lip 13*a* of the interior side wall 7*a*, and wherein the back face 107*a* of the retainer means 31*a* is in frictional engagement and is in communication with the interior side wall 7*a* at a location below the negative return surface 17*a* of the lip 13*a* and above the back face 51*a* of the track means 29*a*.

FIG. 1 further shows the elastic gasket 81*a* in the track means 29*a* is compressed to establish a sealed engagement of the bottom face 67*a* of the track means 29*a* with the trough section 15*a* of the interior side wall 7*a* when the retainer means 29*a* is completely positioned and in frictional engagement with the top face 43*a* of the track means 29*a* and the negative return surface 17*a* of the lip 13*a* of the interior side wall 7*a*.

As is shown in FIGS. 1–3, the sum of the height of the (a) track assembly 27*a*, (b) the elastic gasket 81*a* in an uncompressed state and positioned in the groove 79*a*, and (c) the maximum height of the retainer means 31*a*, is greater than the clearance height from the lowest portion of the trough section 15*a* to the negative return surface 17*a* of the lip 13*a*.

FIG. 2 shows retainer means 31*a* being rotated into position and thus resulting in mechanical frictional engagement with the track means 29*a*. The chamfered face 99*a* and heel face 110*a* of the retainer means 31*a*, and the top face 43*a* of the track means 29*a* and the elastic gasket 81*a* allow for the rotation and snap-fit of the track assembly 27*a* into the final position as shown in FIGS. 1 and 3. FIG. 2 illustrates the leverage action of the snap-fit of the retainer means 31*a* compressing the track means 29*a* and the elastic gasket 81*a* into the oval cross-section of the trough section 15*a*. FIG. 1, shows the final position of the track assembly 27*a* with elastic gasket 81*a* in a compressed state to maintain a tight and secure fit of the track assembly 27*a* in the cavity 19*a*, of the interior side wall 7*a*. The retainer means 31*a*, 31*b* is sized in the vertical dimension of the interior side wall 7*a*,7*b* when the elastic gasket 81*a*, 81*b* is deformed into a semi-flattened shape and thus resulting in the elastic gasket's 81*a*, 81*b* sealed engagement with the trough section 15*a*, 15*b* of the interior side wall 7*a*, 7*b*, respectively. It will be appreciated by those skilled in the art that the deformation of the elastic gasket 81*a*, 81*b* is designed to apply sufficient constant pressure on the track 33*a*, 33*b* and the retainer means 31*a*, 31*b* to keep the track assembly 27*a*, 27*b* in permanent compression and position, respectively.

In an optional embodiment of the present invention as shown in FIG. 3, a hole is drilled and a pin 131 is inserted through the hole created through the incline face 91*a* of the retainer means 31*a* and through the body of the retainer means 31*a* and through the top face 43*a* and the body of the track 33*a*. Preferably, grouting is placed in the area 132 (FIG. 3) above the pin 131 (and surrounding the circumference of the pin 131) for establishing a sealed engagement of the pin 131 to and in the body of the retainer means 31*a* and the body of the track 33*a*. The grouting used is preferably of a polymer composite as described in U.S. Pat. No. 5,079,050.

It will be appreciated by those skilled in the art that the track of the present invention may be made up of one or more modular sections. The modular sections of the track are selected from a group of straight modules and curved modules. Preferably, each of the curved modules has a radius of curvature of from about 180 to 390 millimeters. It will also be appreciated by those skilled in the art that the retainer means of the present invention may be made up of one or more of modular sections, wherein the modular sections are selected from a group of straight modules and curved modules, and preferably, wherein each of the curved modules has a radius of curvature of from about 180 to 390 millimeters.

Whereas particular embodiments of the present invention have been described herein for the purpose of illustration, it will be evident to those skilled in the art that numerous variations of the details of the present invention may be made without departing in the invention as defined in the appended claims.

We claim:

1. A container for use in an electrolytic process comprising:

(a) a cured polymer concrete shell having a floor, a pair of tapered interior side walls wherein said taper provides a greater width at the top of said shell relative to said floor of said shell, and a pair of opposed interior end walls, wherein each of said interior side walls include a lip and trough section, said lip having a negative return surface that is integrally cast on the interior of said interior side wall of said shell wherein said lip is located above said trough section, said trough section is integrally cast at the bottom portion of said interior side wall of said shell, and wherein said trough section is in juxtaposition to and in communication with said floor, and wherein said lip and said trough section form an area in said interior side wall having a cavity, wherein said lip and said trough section extend in a substantially horizontal path along the length of each of said interior side walls, and wherein said floor has a first end, a second end, and a middle section disposed between said first end and said second end, wherein said first end of said floor has an arcuate shape, and that bows upwardly relative to said middle section of said floor such that said first end of said floor communicates with one of said end walls of said shell, and wherein said lip and said trough section continue from said horizontal path along said length of said interior side wall to form a curved elbow transition section on said interior side wall having a radius of curvature that is substantially similar to the radius of curvature of said arcuate shape of said first end of said floor, and wherein said lip and said trough section continue to extend in a vertical path on said interior side wall from said curved elbow transition section to the top of said shell, wherein any one point of reference along said lip and said trough section of one of said interior side wall is equidistant relative to a mirror-image corresponding point of reference of said lip and said trough section of the other said interior side wall throughout said horizontal paths, said curved elbow transition sections and said vertical paths; and (b) at least two track assemblies each having (i) track means for mechanically engaging and guiding a bendable separating member wherein said track means is in juxtaposition to and in communication with at least a portion of said cavity of said interior side wall formed by said trough section and said lip, and (ii) retainer means for frictionally engaging said track means and said negative return surface of said lip of said interior side wall for securing said track means to said interior side wall of said shell, wherein said retainer means is in communication with and is positioned above said track means and below said negative return surface of said lip, and wherein one track assembly is in juxtaposition to and in communication with one of said interior side walls, and wherein the other track assembly is in juxtaposition to and in communication with said other interior side wall.

2. The container of claim 1 wherein any one point of reference along said one track assembly is equidistant relative to a mirror image corresponding point of reference of said other track assembly.

3. The container of claim 1 wherein said track means comprises a track having (i) a front face having a first end, a second end and a middle section disposed between said first and said second ends, wherein said front face of said track is oriented such that it is exposed to the open interior space of said shell, (ii) a top face having a first end, a second end and a middle section disposed between said first and said second ends, wherein said second end of said front face of said track is in communication with said first end of said top of said track, (iii) a back face having a first end, a second end and a middle section disposed between said first and said second ends, wherein said first end of said back face of said track is in communication with said second end of said top face of said track, and wherein said back face of said track is in juxtaposition to and in communication with a portion of said interior side wall above said trough section and below said lip, (iv) a chamfered section having a first end, a second end and a middle section disposed between said first and said second ends wherein said first end of said chamfered section of said track is in communication with said second end of said back face of said track, and wherein said chamfered section of said track is free of communication with said interior side wall, (v) a bottom face having a first end, a second end and a middle section disposed between said first and said second ends, wherein said first end of said bottom face of said track is in communication with said second end of said chamfered section of said track, and wherein said second end of said bottom face of said track is in communication with said first end of said front face of said track, and (vi) a pair of side walls wherein each side wall is in communication with said front face, said top face, said back face, said chamfered section and said bottom face of said track, wherein said bottom face of said track has an arcuate shape and wherein said bottom face of said track has a groove extending from one side wall of said track to the other side wall of said track, wherein said groove accommodates a portion of a circumference of an elastic gasket, and wherein said middle section of said front face of said track has a slot for engaging and guiding said bendable separating member.

4. The container of claim 3 wherein said retainer means has (i) a front face having a first and second end and a middle section disposed between said first and said second ends, (ii) an inclined face having a first end, a second end, and a middle section disposed between said first and said second ends, and wherein said first end of said inclined face of said retainer means is in communication with said second end of said front face of said retainer means, (iii) a chamfered face having a first end, a second end and a middle section disposed between said first and said second ends, wherein said first end of said chamfered face of said retainer means is in communication with said second end of said inclined face of said retainer means, (iv) a back face having a first end, a second end and a middle section disposed between said first and said second ends, and wherein said first end of said back face of said retainer means is in communication with said second end of said chamfered face of said retainer means, (v) a heel face having a first end and a second end, wherein said first end of said heel face is in communication with said second end of said chamfered face, (vi) a bottom face having a first end, a second end and a middle section disposed between said first and said second ends, wherein said second end of said heel face of said retainer means is in communication with said first end of said bottom face of said retainer means, and wherein said second end of said bottom face of said retainer means is in communication with said first end of said front face of said retainer means, and (vii) a pair of side walls, wherein each side wall is in communication with said front face, said inclined face, said chamfered face, said heel face, said back face and said bottom face of said retainer means.

5. The container of claim 4 wherein said bottom face of said retainer mean is in frictional engagement with and is in communication with said top face of said track, and wherein said chamfered face of said retainer means is in frictional engagement with and is in communication with said negative return surface of said lip of said interior side wall, and wherein said back face of said retainer means is in frictional engagement and is in communication with said interior side wall at a location below said negative return surface of said lip and above said back face of said track means.

6. The container of claim 5 wherein said elastic gasket of said bottom face of said track means is compressed to establish a sealed engagement of said bottom face of said track means with said trough section of said interior side wall when said retainer means is positioned in said frictional engagement with said top face of said track means and said negative return surface of said lip of said interior side wall.

7. The container of claim 5 wherein a pin is inserted through said inclined face of said retainer means and through said top face of said track.

8. The container of claim 4 wherein the sum of the heights of said (a) chamfered section and back face of said track means, (b) said elastic gasket in an uncompressed state and (c) the maximum height of said side wall of said retainer means is greater than the clearance height from the lowest portion of said trough section to the negative return surface of said lip.

9. The container of claim 3 wherein said track is made up of one or more modular sections.

10. The container of claim 9 wherein said modular sections of said track are selected from the group of straight modules and curved modules, wherein each of said curved modules has a radius of curvature of from about 180 to 390 millimeters.

11. The container of claim 3 wherein said retainer means is made up of one or more modular sections.

12. The container of claim 11 wherein said modular sections of said retainer means are selected from the group of straight modules and curved modules, wherein each of said curved modules has a radius of curvature of from about 180 to 390 millimeters.

* * * * *